United States Patent [19]

Bobrowski

[11] 4,383,575

[45] May 17, 1983

[54] BASEBOARD HEAT REFLECTOR

[75] Inventor: Louis G. Bobrowski, Berlin, Conn.

[73] Assignee: The Stanley Works, New Britain, Conn.

[21] Appl. No.: 260,309

[22] Filed: May 4, 1981

[51] Int. Cl.[3] ..... F24D 19/02

[52] U.S. Cl. ..... 165/55; 428/40; 428/319.1; 428/354; 165/135; 219/366; 219/368

[58] Field of Search ..... 165/53, 55; 428/40, 428/319.1, 354; 165/135

[56] References Cited

U.S. PATENT DOCUMENTS

| | | | |
|---|---|---|---|
| 2,545,332 | 5/1956 | Cottes | 165/54 |
| 2,568,818 | 9/1951 | O'Day | 165/135 |
| 2,873,097 | 2/1959 | Brandi | 165/135 |
| 4,039,709 | 8/1977 | Newman | 428/286 |

OTHER PUBLICATIONS

Oct. 1980, Nov.-Dec. Issue, Home-Owners How To, Times Mirror Publishing Co., New York, N.Y.

Baum, Many Ways Suggested to Keep Heating Bill Under Control, Hartford Courant, Nov. 1980.

Aluminum and Foam Pipe Insulating Tape, SP1328 (p. 22).

Duct Insulating Wrap, V1375 (p. 21).

*Primary Examiner*—Albert W. Davis, Jr.
*Assistant Examiner*—S. Dotson
*Attorney, Agent, or Firm*—Brumbaugh, Graves, Donohue & Raymond

[57] ABSTRACT

A multilayer heat insulating and reflecting strip is adapted to fit a baseboard heater behind and below the lengthwise extending heating element. An adhesive means along one edge secures the strip in place. The strip can be a laminate of polyvinylchloride foam and aluminum foil.

6 Claims, 2 Drawing Figures

BASEBOARD HEAT REFLECTOR

BACKGROUND OF THE INVENTION

This invention relates to a combined heat insulator and reflector for association with a baseboard heater and more particularly to a strip of multilayer material having a layer of insulating foam and a layer of reflective foil to be located behind and below the heating element of a baseboard heater.

In the past, suggestions have been made to locate insulators and/or reflectors behind conventional radiators. More and more, however, baseboard heaters are replacing conventional radiators. These enclosed, self contained units ordinarily do not provide either insulation or reflection for the heat produced. Therefore, a large part of the heat that such baseboard heaters produce heats the adjacent wall and floor. No product is known to have been specifically provided to correct this situation.

BRIEF SUMMARY OF THE INVENTION

According to this invention, a continuous, elongate strip of multilayer material is provided to fit behind and at least partly below the heating element of an enclosed baseboard heater. The strip is of a foamed insulating plastic such as polyvinylchloride and has laminated thereto a reflective foil layer, for example aluminum foil. Such combinations of materials were known in the prior art, but not in association with baseboard heaters, and never particularly adapted for direct placement in properly fitting relation to a commercial baseboard heater.

Adhesive means along one longitudinal edge of the multilayer strip permits easy location and securing of the multilayer strip behind and below the heating element that extends lengthwise of the baseboard heater. The adhesive means can be a coated-on band of pressure sensitive adhesive or an adhesive-coated tape secured along an edge of the strip.

The strip can be continuously formed, cut to suitable commercial sizes, rolled and shipped to market.

BRIEF DESCRIPTION OF THE DRAWINGS

The above and further advantages of the invention will be more fully understood with reference to the following detailed description of preferred embodiments of the invention, along with the several views of the attached drawings, wherein.

DESCRIPTION OF PREFERRED EMBODIMENTS

Figure 1:
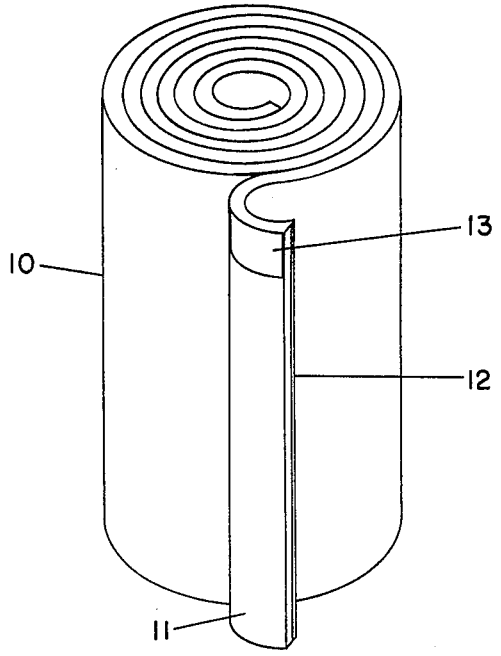
FIG. 1 is a perspective view of a roll of multilayer heat insulating and reflecting material and suitable for use with a baseboard heater.

Turning now to the drawings in detail, FIG. 1 shows a rolled strip 10 of multilayer material that includes a layer 11 of foam, for example ⅛ inch thick foamed polyvinylchloride, and a layer 12 of heat-reflective foil, such as aluminum foil. Along one longitudinal edge, the foamed plastic layer has a coated-on band 13 of pressure sensitive adhesive. Typically, the width W of the multilayer strip is approximately 7¼ to 7½ inches to properly fit behind and at least partially below an elongate heating element 15 in a baseboard heater 20 of the kind illustrated in FIG. 2.

Figure 2:
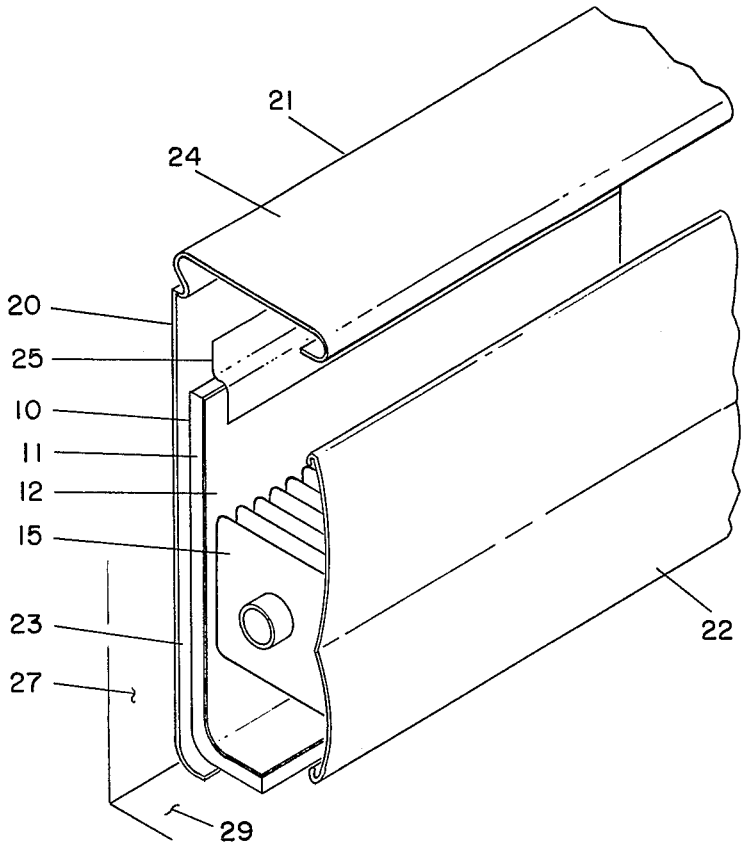
FIG. 2 is a fragmentary perspective view of a baseboard heater equipped with an insulating and reflecting strip like that of FIG. 1.

The baseboard heater 20 of FIG. 2 is a known commercial assembly including, in addition to the elongate heating element 15, an enclosure 21 having a front panel 22 and a back panel 23 with an integrally formed upper panel 24. The back panel 23 curves down and under the element 15. The insulating and reflecting strip 10 is sufficiently flexible to follow the curve of the panel 23 down and under the heating element 15. Along its upper surface, the strip 10 of FIG. 2 has the alternative adhesive coated tape 25 securing its upper edge to the back panel 23 rather than the coated-on adhesive band used for the same purpose. Providing the adhesive means along one edge only has the advantage of permitting easy placement of the strip by slipping the strip down and under the heating element. Adhesive sticking of the strip to the back panel can be largely avoided until the strip is properly placed.

The 7¼ inch width of strip 10 provides almost 90 square inches of reflecting surface per running foot, while the PVC insulating layer greatly reduces wasteful heat radiation, convection, and conduction to the adjacent wall 27 and floor 29. More heat is reflected, radiated and transmitted by convection out and up to the room being heated. If the enclosure includes no bottom or back panel, the strip 10 is located directly against the wall and floor. The strip then serves the additional purpose of preventing any leakage path that may exist in the construction of the home at this point due, for example, to poor carpentry.

The multilayer strip is easily formed continuously by known lamination practice, cut to size, wound onto, for example, a paper core, and shipped. Light pressure on the adhesive coated band of the embodiment of FIG. 1 maintains the roll during shipping, storing and display.

Whereas preferred embodiments of the invention have been described hereinabove, variations therein will be apparent to those skilled in the art without departure from the spirit and scope of the invention as set forth in the appended claims.

I claim:

1. In a heat reflector and insulator for a baseboard heater of the kind including an elongate heating element and an enclosure at least partially enclosing the heating element; the improvement including an elongate strip of multilayer material for positioning behind and below the heating element, said strip having a width corresponding to a distance above the heating element location in the enclosure plus at least a portion of the width of enclosure below the heating element, said strip being sufficiently flexible to wrap partly around the heating element behind and below the heating element, said strip having a layer of foam insulating material for location facing away from the heating element and a layer of reflective foil for location facing the heating element and for reflecting heat therefrom upwards and outward towards a room to be heated, said foam layer serving to at least partly prevent passage of heat to adjacent wall and floor behind and below the heating element.

2. The heat reflector according to claim 1 further comprising adhesive means proximate one edge of said strip and extending lengthwise of the strip for affixing the strip in place behind the heating element.

3. The heat reflector according to claim 2, wherein said adhesive means comprises a coated-on band of pressure sensitive adhesive on the foam layer adjacent said edge.

4. The heat reflector according to claim 2, wherein the adhesive means includes an adhesive-coated tape affixed along said edge to the strip.

5. The heat reflector according to claim 2, wherein the foam layer is ⅛ inch thick polyvinylchloride.

6. The heat reflector according to claim 1, wherein said strip defines approximately more than 80 square inches of reflecting surface per foot of length.

* * * * *